United States Patent [19]

Wishart et al.

[11] Patent Number: 4,613,127

[45] Date of Patent: Sep. 23, 1986

[54] AUTOMATIC RETARD ADJUSTMENT MECHANISM FOR SHEET FEEDING

[75] Inventors: Scott A. Wishart, Waterloo; Tadeusz Pecak, Kitchener; Owen H. Wilson, Breslau; Anthony J. Boon, Kitchener, all of Canada

[73] Assignee: NCR Corporation, Dayton, Ohio

[21] Appl. No.: 768,763

[22] Filed: Aug. 23, 1985

[51] Int. Cl.[4] ..... B65H 5/06

[52] U.S. Cl. ..... 271/274; 271/31.1; 271/122

[58] Field of Search ..... 271/122, 124, 125, 274, 271/31.1

[56] References Cited

U.S. PATENT DOCUMENTS

| | | | |
|---|---|---|---|
| 2,635,874 | 4/1953 | La Bore | 271/125 X |
| 3,052,465 | 9/1962 | David | 271/36 |
| 3,525,518 | 8/1970 | Oaten | 271/41 |
| 4,496,339 | 1/1985 | Moll | 271/274 X |
| 4,552,353 | 11/1985 | Tanaka | 271/124 |

*Primary Examiner*—Richard A. Schacher

*Attorney, Agent, or Firm*—Wilbert Hawk, Jr.; Albert L. Sessler, Jr.

[57] ABSTRACT

A sheet feeding apparatus includes a retard mechanism to prevent the inadvertent feeding of doubled or overlapped sheets. The retard mechanism includes a plurality of belts in an assembly positioned adjacent to a sheet feeding roller, and rotating in such a direction as to retard the sheets being fed. The retard assembly is mounted on the free end of a lever arm pivotally secured adjacent to its other end to the base of the sheet feeding apparatus. The lever arm with the retard assembly mounted thereon is spring-urged toward the feed roller, but may be moved slightly away from said roller to accommodate the thickness of the sheet being fed between the feed roller and the retard assembly. A dual spring arrangement contained in the lever arm permits the lever arm to move with relatively little force to accommodate passage of a single sheet, but to resist more vigorously any additional movement, such as would be required for the passage of double or overlapped sheets. A one-way retaining device permits movement of the lever arm and retard assembly toward the feed rollers as the roller and belts wear, but prevents movement away from said roller except for the limited movement permitted to accommodate sheets during feeding. The retaining device may be released to permit the lever arm and retard assembly to be swung away from the feed roller for replacement of the feed roller and retard belts when worn.

15 Claims, 11 Drawing Figures

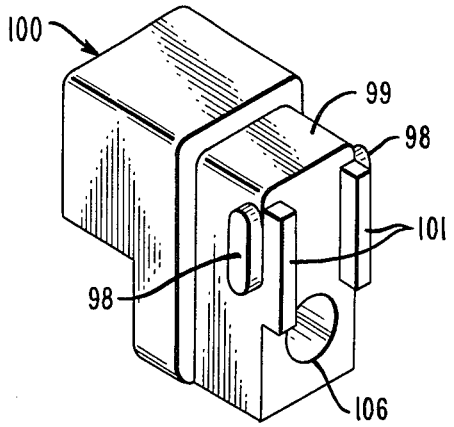
FIG. 7
FIG. 8
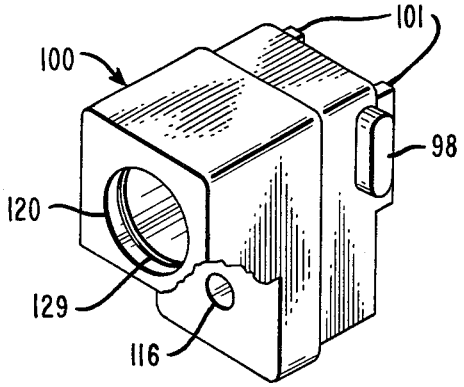
FIG. 9
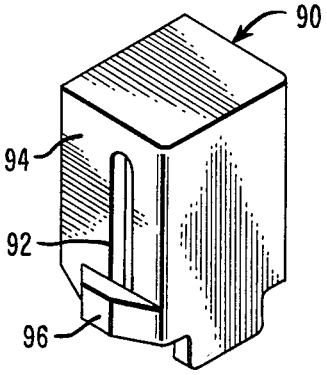
FIG. 10
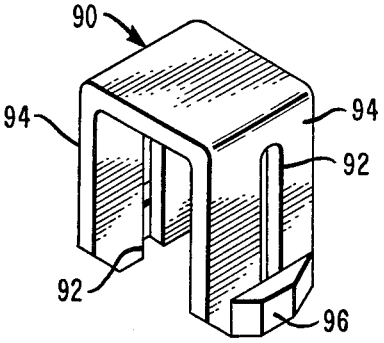

AUTOMATIC RETARD ADJUSTMENT MECHANISM FOR SHEET FEEDING

BACKGROUND OF THE INVENTION

This invention relates to sheet feeding apparatus, and more particularly relates to means for preventing feeding of doubled or overlapping sheets.

In feeding sheets, including currency and documents of various types such as checks, it is usually important that only one document at a time is fed. Various types of detectors for detecting the simultaneous feeding of multiple documents have been developed, as have various devices for preventing the feeding of more than one document at a time.

One such sheet separating device is disclosed in U.S. Pat. No. 3,052,465, in which a restraint belt cooperates with a sheet driving wheel to provide a sheet-driving throat therebetween. The sheet driving wheel drives sheets to be fed in a sheet advancing direction, while the restraint belt exerts a lesser force acting on the sheet surface adjacent to it to restrain movement of the sheet in the advance direction and thus separate any sheets which may be clinging together and which would otherwise be fed as a "double" in an improper feeding operation. A gravity operated arrangement maintains tension in the restraint belt and compensates for wear in the driving wheel and the restraining belt. A manually operated mechanism is provided to permit releasing of tension in the restraint belt and replacement of the belt and wheel when worn.

The apparatus of U.S. Pat. No. 3,052,465, in the form in which it is shown, does not appear to be adapted for feeding of vertically oriented sheets, because of the gravity-operated mechanism employed. Also, an increase in the compactness of such devices is desirable.

SUMMARY OF THE INVENTION

In the present invention, having a sheet feeding roller and cooperating retard device, an automatic sheet feeding retard device adjustment mechanism is provided which employs a multiple spring force arrangement to permit limited movement of the retard device as sheets are fed, together with a clutch or retaining device which permits adjustment travel of the retard device as components of the feeding apparatus wear, but which prevents movement of the retard device out of operative relation with the feeding roller except when released to permit component replacement or other service.

In accordance with one embodiment of the present invention, sheet feeding apparatus comprises: a base including a sheet feed station; sheet driving means positioned on one side of said sheet feed station and rotatable in one direction for driving a first sheet; sheet retarding means positioned on the opposite side of said sheet feed station in operative relation to said driving means and rotatable in the same direction as said sheet driving means for retarding the movement of a further sheet which might otherwise be driven with said first sheet; mounting means pivotally mounted on said base and carrying said sheet retarding means thereon; support means secured to said base; biasing means supported by the support means and engageable with the mounting means; spring means extending between the biasing means and the support means and urging the biasing means into engagement with the mounting means; retaining means coupled to the support means and the biasing means and movable between a first position in which the biasing means is free to move in a first direction into engagement with the mounting means and is retained against movement in an opposite direction, and a second position in which the biasing means is free to move in said opposite direction; and resilient means operatively associated with said mounting means and engageable with said biasing means to permit limited movement of said mounting means and the retarding means mounted thereon in a direction away from the sheet driving means.

It is accordingly an object of the present invention to provide, in a sheet feeding apparatus, a novel and efficient automatic retard adjustment mechanism.

A further object is to provide, in a sheet feeding apparatus, an automatic retard adjustment mechanism using multiple force spring means to accommodate sheets being fed, while resisting the feeding of double or overlapping sheets.

A further object is to provide, in a sheet feeding apparatus, an automatic retard adjustment mechanism which includes wear-compensating mechanism to urge the retard mechanism into operative engagement with a sheet feeding mechanism and normally to prevent movement of said wear-compensating mechanism away from said sheet feeding mechanism.

A further object is to provide, in a sheet feeding apparatus, an automatic retard adjustment mechanism which includes a clutch device which normally holds the retard mechanism in engagement with a feed roller, but which may be operated to release the retard mechanism to permit replacement of worn components.

A further object is to provide, in a sheet feeding apparatus, an automatic retard mechanism which automatically compensates for wear in the feeding components.

A further object is to provide, in a sheet feeding apparatus, an automatic retard mechanism which prevents feeding of double or multiple sheets.

With these and other objects, which will become apparent from the following description, in view, the invention includes certain novel features of construction and combinations of parts, a preferred form or embodiment of which is hereinafter described with reference to the drawings which accompany and form a part of this specification.

BRIEF DESCRIPTION OF THE DRAWINGS

FIGS. 7 and 8 are two perspective views of a spring-holding block element.

FIGS. 9 and 10 are two perspective views of a gap control element.

DESCRIPTION OF THE PREFERRED EMBODIMENT

Figure 1:
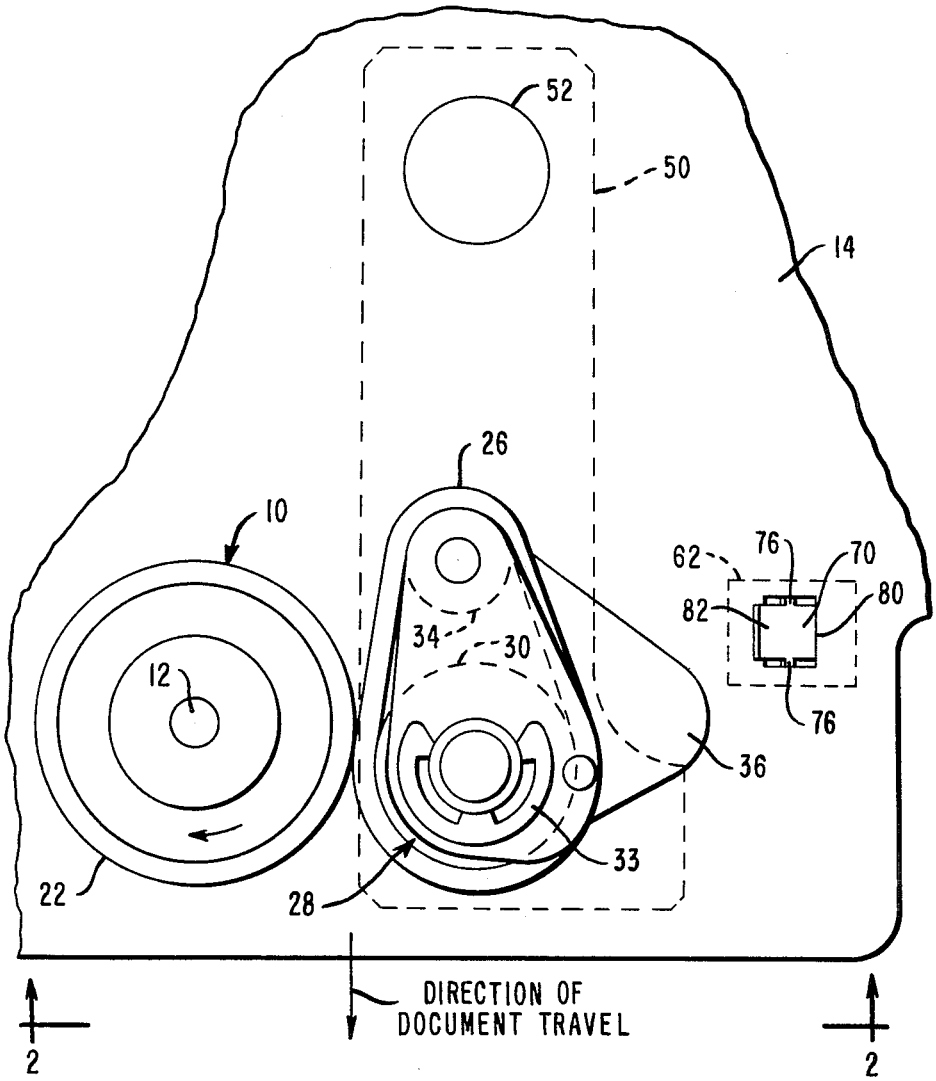
FIG. 1 is a fragmentary plan view of a sheet feeding apparatus embodying the present invention.
Figure 2:
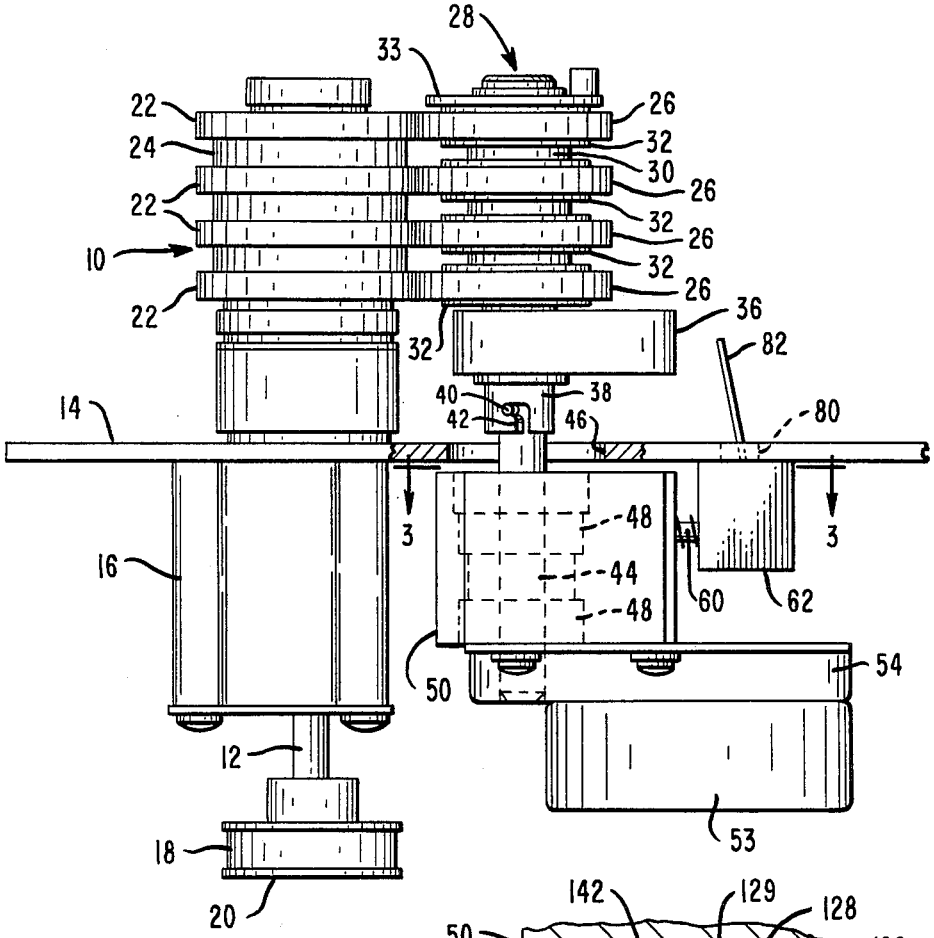
FIG. 2 is a sectional view taken along line 2—2 of FIG. 1.

Referring now to FIGS. 1 and 2, the sheet feeding apparatus of the present invention comprises a drive roller 10 mounted on a shaft 12 which extends through a base 14, is journalled in a bearing housing 16 secured to said base, and is driven by a motor (not shown), acting through a belt 18 and a pulley 20 fixed to the shaft 12. In the illustrated embodiment, the drive roller 10 includes a plurality of individual ribs 22, formed integrally with a central barrel 24 and adapted to engage and drive a check, currency or other sheet.

The ribs 22 of the drive roller 10 cooperate with correspondingly positioned belts 26 which constitute part of a retard mechanism 28. The mechanism 28 also includes a drive element 30, a plurality of belt supports 32 mounted on the element 30 and receiving the belts 26, and an idler 34, around which the belts 26 also extend. The idler 34 is journalled in a plate 36, through which a hollow shaft 38 extends. The supports 32 are fixed on the shaft 38 and rotate therewith, driving the belts 26 in the same direction of rotation as the ribs 22 of the drive roller 10 are driven. A clip 33 retains the drive element 30, the belt supports 32 and the shaft 38 in assembled relation. Since these sets of ribs and belts are on opposite sides of the sheet being driven therebetween, they exert opposite forces on the sheet being fed, with the ribs 22 of the driving roller 10 exerting the stronger force, so that a single sheet is driven forward against the retrograde force exerted by the belts 26 of the retard mechanism 28.

When two or more sheets stick together, as sometimes happens, the sheet adjacent to the drive roller 10 is driven forward thereby, while the sheet adjacent to the retard mechanism 28 is urged in the opposite direction by the belts 26, thus separating the sheets, and permitting only a single sheet to be fed, as is normally desired in a sheet feeding apparatus.

The hollow shaft 38 is connected by means of a pin 40 and slot 42 connection to a shaft 44 which extends through an enlarged opening 46 in the base 14 and which is journalled by means of bearings 48 in a mounting lever 50 which is pivotally mounted below the base 14 by means of a pivot 52. A motor 53 is attached to the mounting lever 50 by a gear box 54 which may be an integral part of the motor 53. Said motor 53 drives the shaft 44. The motor 53 may suitably be a slow-speed one r.p.m. motor, for driving the retard mechanism 28 at an appropriate speed.

Figure 3:
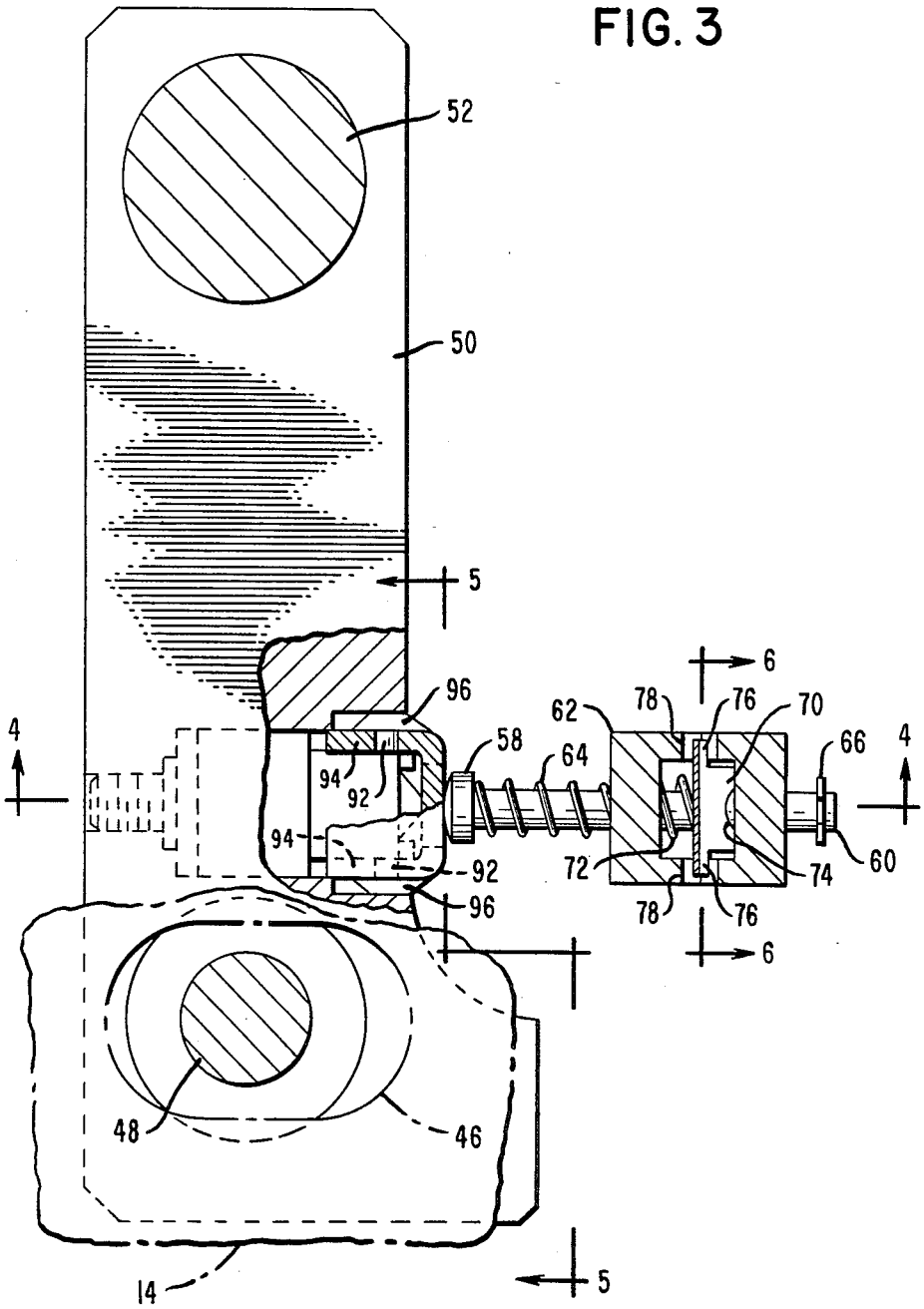
FIG. 3 is a sectional view taken along line 3—3 of FIG. 2.
Figure 6:
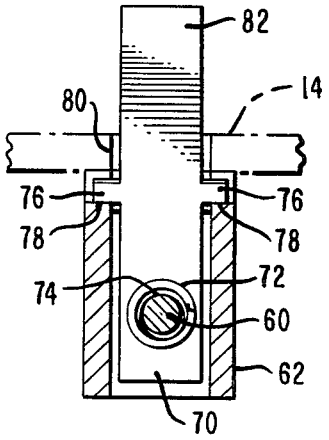
FIG. 6 is a sectional view taken along line 6—6 of FIG. 3.

The mounting lever 50 is normally urged in a clockwise direction as viewed in FIG. 3 about its pivot 52. An enlarged head 58 on a stud 60 normally engages a surface 51 which comprises part of a mechanism contained in a cavity in the lever 50. The stud 60 is mounted for axial movement through two apertures 61 in a bracket 62 fixed to the underside of the base 14. A spring 64 urges the stud 60 to the left as viewed in FIGS. 3 and 4. A clip 66 fixed to the stud 60 near its right end limits the leftward movement of said stud. A retainer or clutch 68 comprising a lever 70 and a spring 72 around the stud 60 permits movement of said stud to the left but prevents movement of the stud 60 to the right unless the lever 70 is moved from the position in which it is shown in FIG. 3. The lever 70, which is also shown in FIG. 6, has an aperture 74 through which the stud 60 passes, and is provided with projections 76 at each side which engage notches 78 in the bracket 62 to provide a fulcrum for the lever. The upper part of the lever 70 extends through an opening 80 in the base 14 and forms a handle 82, by which the lever can be moved.

Figure 4:
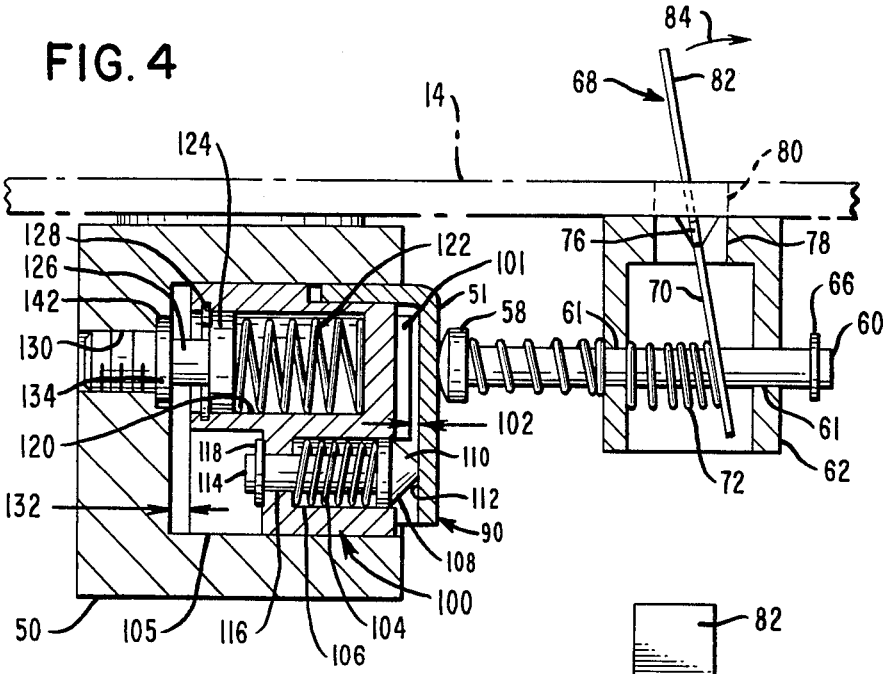
FIG. 4 is a sectional view taken along line 4—4 of FIG. 3.

It will be seen that when the lever 70 is in the position in which it is shown in FIG. 4, the upper and lower portions of the circumference of the aperture 74 engage the upper and lower portions of the circumference of the stud 60, and prevent axial movement of said stud to the right as viewed in FIG. 4. The stud 60 is, however, free to move to the left, as viewed in FIG. 4, at the urging of spring 64.

When it is desired to release the stud 60 to permit its movement to the right, as may be desired, for example, when the belts 26 and/or the roller 10 must be replaced, the handle 82 of the lever 70 is moved to the right, in a clockwise direction, as indicated by the arrow 84 in FIG. 4. This rocks the lever 70 about the fulcrum formed by projections 76 and notches 78, and causes the upper and lower circumferential portions of the aperture 74 to move out of engagement with the stud 60, so that said stud may be moved to the right. The mounting lever 50 may then be swung counterclockwise as viewed in FIG. 3 to permit servicing of the belts 26 or the roller 10, or for other appropriate purpose.

Figure 5:
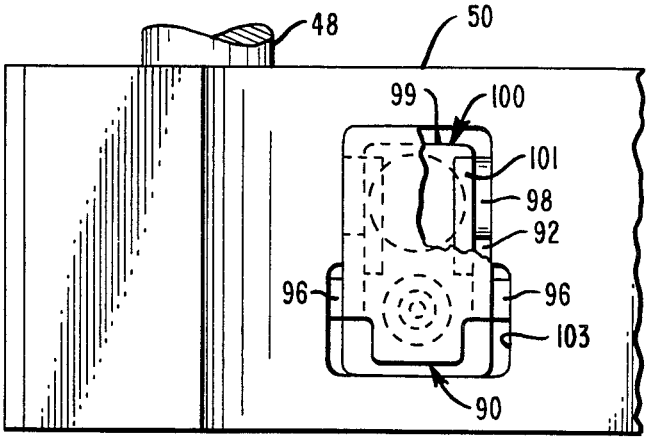
FIG. 5 is a sectional view taken along line 5—5 of FIG. 3.

The surface 51, which the enlarged head 58 of the stud 60 normally engages, constitutes one exterior surface of a gap control element 90. This element is shown in perspective view in FIGS. 9 and 10, and in assembled relation with other parts in FIGS. 3, 4 and 5. As best shown in FIGS. 9 and 10, the element 90 is a four-sided element with slots 92 in the two opposed sides 94, each slot extending all of the way to the lower edge of its respective side 94. Projections 96 extend outwardly from the opposed sides adjacent to the lower ends of the slots 92.

The slots 92 receive projections 98 of a spring-holding block 100 as the gap controlling element 90 is slid downwardly on to a reduced portion 99 of said block 100. The assembled element 90 and block 100 fit within a cavity 105 in the mounting lever 50. The cavity 105 has an enlarged lower portion 103 to receive the projections 96. The slots 92 are wider than the projections 98 so that a limited amount of lateral movement, represented by the gap 102 in FIG. 4, between the element 90 and the block 100 is permitted. Spacers 101 on the block 100 assist in the positioning of the element 90 with respect to the block 100. The surface 51 of the element 90 is urged to the right as viewed in FIG. 4, so as to maintain the gap 102, by a relatively light coil spring 104 disposed within a bore 106 in the spring-holding block 100, coacting with the rear side of an enlarged head 108 having an end 110 which engages with an inner surface 112 of the element 90, opposite the surface 51. The head 108 is part of a stud 114 which extends through the coil of the spring 104 in the bore 106 and through a reduced aperture 116 extending through the block 100. A clip 118 on the stud 114 retains it against undesired movement out of the bore 106.

A second large bore 120 in the spring-holding block 100 opens to the rear of the block and receives a spring 122 which is larger and heavier than the spring 104. This spring 122 is compressed between the closed end of the bore 120 and the head 124 of a stud 126. To insure that the spring 122 remains compressed, the head 124 is held in place by a circlip 128 which is positioned in a groove 129 (FIG. 8) of the block 100. The stud 126 includes the head 124, a flange 134, a threaded portion 136 and a screwdriver slot 138.

Figure 11:
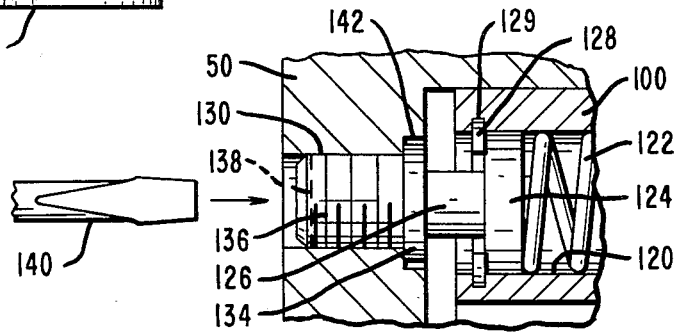
FIG. 11 is a fragmentary sectional view of the spring-holding block element.

The element 90 is assembled onto the block 100 by aligning the slots 92 with the projections 98 and moving the element 90 downwardly, with respect to the block 100. As previously mentioned, the inner surface 112 of the element 90 engages the end 110 of the head 108. The assembled block 100 and element 90 are then placed in the cavity 105, by insertion in a leftward direction, as viewed in FIG. 4, so that the threaded portion 136 of the stud 126 meets a threaded hole 130 in the block 50. While slight pressure is exerted on the face 51, the end of a screwdriver 140 is engaged with the screwdriver slot 138, as indicated in FIG. 11. The screwdriver 140 is then turned in a counterclockwise direction until the flange 134 is seated tightly against the closed face of a cavity 142.

Now a small force applied to the face 51 will compress the spring 104 until the gap 102 is closed. Further increase in force will compress the spring 122 against the head 124. This movement will continue with the application of increased force until the gap 132 is closed. No further movement of the mounting lever 50 is possible until the handle 82 is moved in the direction of arrow 84.

It will be seen that the spring 122 urges the assembled block 100 to the right, as viewed in FIG. 4. Independently, the spring 104 urges the element 90 to the right, as viewed in FIG. 4. Movement of the mounting lever 50 to the right, as viewed in FIG. 4, is thus resisted after the surface 51 has engaged the head 58, and after the gap 102 has been closed against the force of the weaker spring 104. The maximum movement of the assembled element 90 and block 100 within the cavity 105 is represented by the gap 132 shown in FIG. 4.

The effect of the dual spring arrangement described above is that when a single sheet of normal thickness is fed through the throat defined by the feed roller 10 and the retard mechanism 28, the retard mechanism 28 is permitted to move slightly to the right, as viewed in FIGS. 1 and 4, against the head 58 of the stud 60, which is already in contact with the surface 51, by compression of the relatively light spring 104, and narrowing or elimination of the gap 102 between the surface 112 of the element 90 and the spacers 101 of the block 100. After the sheet has passed, the force of the spring 104 causes the element 90 and the block 100 to move away from each other to restore the gap 102.

If a double sheet or any other item of unusual thickness enters the throat between the feed roller 10 and the retard mechanism 28, the gap 102 is first closed, as described above, after which the retard mechanism 28 and the mounting lever 50 are urged further to the right, against the additional force of the stronger spring 122. Against this resistance, the mounting lever 50 is capable of additional movement to the extent of the gap 132, after which no further movement is permitted. The combined effect of the springs 104 and 122 of the retard mechanism 28 and the limited gap 102 available will in most instances separate two doubled or overlapped sheets, so that only one of said sheets at a time will actually be fed.

While the form of the invention shown and described herein is admirably adapted to fulfill the objects primarily stated, it is to be understood that it is not intended to confine the invention to the form or embodiment disclosed herein, for it is susceptible of embodiment in various other forms within the scope of the appended claims.

We claim:

1. Sheet feeding apparatus comprising, in combination:

a base including a sheet feed station;

sheet driving means positioned on one side of said sheet feed station and rotatable in one direction for driving a first sheet;

sheet retarding means positioned on the opposite side of said sheet feed station in operative relation to said driving means and rotatable in the same direction as said sheet driving means for retarding the movement of a further sheet which might otherwise be driven with said first sheet;

mounting means pivotally mounted on said base and carrying said sheet retarding means thereon;

support means secured to said base;

biasing means supported by the support means and engageable with the mounting means;

spring means extending between the biasing means and the support means and urging the biasing means into engagement with the mounting means;

retaining means coupled to the support means and the biasing means and movable between a first position in which the biasing means is free to move in a first direction into engagement with the mounting means and is retained against movement in an opposite direction, and a second position in which the biasing means is free to move in said opposite direction; and resilient means operatively associated with said mounting means and engageable with said biasing means to permit limited movement of said mounting means and the retarding means mounted thereon in a direction away from the sheet driving means.

2. The sheet feeding apparatus of claim 1, in which said resilient means includes first relatively weak spring means to enable the sheet retarding means to move slightly away from the sheet driving means as a sheet passes therebetween, and second relatively strong spring means to enable the sheet retarding means to move slightly further away from the sheet driving means with stronger resistance.

3. The sheet feeding apparatus of claim 1 in which an aperture is located in said mounting means and in which said resilient means is positioned in said aperture and includes a block slidably mounted in said aperture and including two spring-receiving bores; a relatively light spring and a first plunger in one of said bores; a movable element mounted on said block so that one side of said movable element engages said plunger and the other side of said movable element engages said biasing means; and a relatively stronger spring and a second plunger in the other of said bores, said second plunger extending between the relatively stronger spring and one end of said aperture in said mounting means.

4. The sheet feeding apparatus of claim 3 in which the movable element is free to move a first clearance distance with respect to the block, against the force of the relatively light spring.

5. The sheet feeding apparatus of claim 4 in which the block is free to move a second clearance distance with respect to the aperture in the mounting means, against the force of the relatively stronger spring.

6. The sheet feeding apparatus of claim 1 in which said retaining means includes a lever arm rockably mounted in said support means releasably engaging said biasing means, and retaining spring means engaging said lever arm and urging it to a position in which said biasing means is retained against movement in one direction.

7. The sheet feeding apparatus of claim 1 in which the mounting means is located on one side of the base, and in which the sheet retarding means is located on the other side of the base and includes a shaft which extends through an aperture in the base and which is journalled in the mounting means.

8. The sheet feeding apparatus of claim 3 in which projections on the sides of said block engage in slots in the movable element to retain the block and the movable element in operative relationship.

9. The sheet feeding apparatus of claim 8 in which said block includes spacing means to limit the relative movement between said block and said movable element.

10. The sheet feeding apparatus of claim 7 in which the shaft of the sheet retarding means extends through the mounting means, said apparatus also including driving means mounted on said mounting means and coupled to said shaft for driving said sheet retarding means.

11. The sheet feeding apparatus of claim 6 in which an aperture is provided in said base at the location of the support means, and in which the lever arm of the retaining means projects through said aperture.

12. Sheet feeding apparatus comprising, in combination:

a base including a sheet feed station;

sheet driving means positioned on one side of said sheet feed station and rotatable in one direction for driving a first sheet;

sheet retarding means positioned on the opposite side of said sheet feed station in operative relation to said driving means and rotatable in the same direction as said sheet driving means for retarding the movement of a further sheet which might otherwise be driven with said first sheet;

mounting means pivotally mounted on said base and carrying said sheet retarding means thereon;

support means secured to said base;

resiliently urged biasing means supported by the support means and normally engaging said mounting means to maintain said sheet retarding means in operative engagement with said sheet driving means for causing the driving of single sheets through said sheet feed station; and retaining means coupled to the support means for normally retaining said biasing means in engagement with said mounting means and selectively releasable to free said mounting means for movement about its pivot to separate the sheet driving means from the sheet retarding means.

13. The sheet feeding apparatus of claim 12 in which said retaining means includes a lever arm rockably mounted in said support means, releasably engaging said biasing means, and retaining spring means engaging said lever arm and urging it to a position in which said biasing means is retained against movement in one direction.

14. The sheet feeding apparatus of claim 13 in which said lever arm includes an aperture through which the biasing means extends, and in which the edges of said aperture engage the biasing means to prevent movement thereof in one direction when said lever arm is in a first position and in which said edges do not engage said biasing means when said lever arm is in a second position.

15. The sheet feeding apparatus of claim 12 in which the mounting means is located on one side of the base and in which the sheet retarding means is located on the other side of the base and includes a shaft which extends through an aperture in the base and which is journalled in the mounting means.

* * * * *